US007306185B1

(12) United States Patent
Miller

(10) Patent No.: US 7,306,185 B1
(45) Date of Patent: Dec. 11, 2007

(54) UNIVERSAL TOILET PAPER DISPENSER SYSTEM

(76) Inventor: Jean Anne Miller, 3847 McCoy Rd., Blacksburg, VA (US) 24060

( * ) Notice: Subject to any disclaimer, the term of this patent is extended or adjusted under 35 U.S.C. 154(b) by 345 days.

(21) Appl. No.: 11/170,680

(22) Filed: Jun. 29, 2005

(51) Int. Cl.
*B65H 16/04* (2006.01)

(52) U.S. Cl. ..... 242/592; 242/597; 242/597.8

(58) Field of Classification Search ..... 242/591, 242/592, 597, 597.1, 597.2, 597.4, 597.8; 4/300.41; 312/34.8; D6/518, 519, 521, D6/522, 523
See application file for complete search history.

(56) References Cited

U.S. PATENT DOCUMENTS

| | | | | |
|---|---|---|---|---|
| 1,226,453 | A | | 5/1917 | Boyle |
| 1,259,007 | A | * | 3/1918 | Fifield |
| 2,073,429 | A | | 3/1937 | Spicher |
| 2,518,328 | A | | 8/1950 | Janonis |
| 3,228,618 | A | | 1/1966 | Bracken |
| 3,475,067 | A | | 10/1969 | Girard |
| 3,620,465 | A | | 11/1971 | Wyatt |
| 3,806,055 | A | | 4/1974 | Bauman |
| D313,716 | S | | 1/1991 | Jacques |
| 5,299,874 | A | * | 4/1994 | DeVoe |
| 5,402,978 | A | | 4/1995 | Larson |
| 5,653,403 | A | | 8/1997 | Ritchey |
| 5,690,302 | A | | 11/1997 | Batts |
| 5,868,345 | A | | 2/1999 | Beisser |
| 5,871,170 | A | | 2/1999 | Morales et al. |
| 5,967,452 | A | | 10/1999 | Wilder |
| 6,206,464 | B1 | * | 3/2001 | Santa Rosa et al. |
| 6,405,971 | B1 | | 6/2002 | Trecartin |
| D461,082 | S | | 8/2002 | Snell |
| 6,527,219 | B1 | | 3/2003 | Trecartin |
| 6,575,316 | B2 | | 6/2003 | Lin |
| D477,730 | S | | 7/2003 | Hoernig |
| 2003/0080081 | A1 | | 5/2003 | Lin |
| 2003/0189126 | A1 | | 10/2003 | Hale |

* cited by examiner

*Primary Examiner*—William A Rivera

(57) ABSTRACT

An improved toilet paper dispenser system that employs an elongated support arm having, as a component, a flexible arm segment which is bendable in three dimensions. The support arm is secured at one end to a toilet tank or rigid structure using a mounting attachment. The flexible segment is positioned on the support arm sufficiently near to the mounting attachment so the support arm will not constitute an elongated rigid obstruction in a bathroom. At the opposite end of the support arm is a toilet roll holder that can support a toilet roll and dispense toilet paper in a wide variety of orientations. The toilet roll can be supported by the support arm in a wide variety of positions in three dimensions.

20 Claims, 7 Drawing Sheets

UNIVERSAL TOILET PAPER DISPENSER SYSTEM

CROSS-REFERENCE TO RELATED APPLICATIONS

Not Applicable

FEDERALLY SPONSORED RESEARCH

Not Applicable SEQUENCE LISTING

Not Applicable

BACKGROUND OF THE INVENTION

1. Field of Invention

This invention relates to toilet paper holders and more specifically to a toilet paper dispenser system for providing easy access to a roll of toilet paper.

2. Description of the Prior Art

The well known problem with the use of toilet paper holders/dispensers is expressed in U.S. Pat. No. 6,527,219 B1: "A problem with toilet paper holders in general is that their location is dictated by bathroom and cabinet design. Due to the limitations inherent in many such designs, a conventional toilet paper holder is often, by necessity, placed in a position where it is difficult to access by persons positioned upon a toilet; requiring an undue, and often painful, twisting and turning." The crowded prior art reveals two general strategies for attempting to deal with this problem.

One approach (for example U.S. Pat. No. 6,527,219 B1, U.S. Pat. No. 6,405,971 B1, U.S. Pat. No. 5,868,345, U.S. Pat. No. 5,967,452, U.S. Pat. No. 5,871,170, U.S. Pat. No. 1,226,453) involves devices that employ an elongated arm to allow the toilet roll to be accessed close to the user when the device is mounted at a more distant location. A significant, and unappreciated, disadvantage of these devices is that the elongated arm, being rigid in at least one direction and extending some distance across the bathroom, represents an undesirable obstruction. An accidental collision between a person and the arm, in the direction in which the arm is rigid, is likely to result in damage to the device or injury to the person. Furthermore, several of these devices are of complex construction and employ telescopic components, hinges or pivot joints. These devices permit only limited and awkward adjustment, typically only in one or two dimensions, and are unsuitable for a wide variety of users and bathroom situations.

The second strategy for dealing with the above stated problem involves devices that can be mounted in novel locations. For example, U.S. Pat. No. 3,806,055 U.S. Pat. No. 3,475,067 and U.S. Pat. No. 1,226,453 have the device attached in the proximity of the toilet bowl. These devices are ineffective as solutions to the above stated problem of achieving easy access to the toilet roll. Additionally, they create an obstruction over which a user could trip and also make cleaning more difficult. U.S. Pat. No. 2,518,328 and U.S. Pat. No. 3,228,618 have the toilet paper holder attached to the toilet tank. These devices do not increase the ease with which the toilet roll can be accessed. U.S. Pat. No. 5,402,978 relates to a holder for a spare toilet roll. It is not a functioning toilet roll dispenser and the roll must be removed for use.

SUMMARY OF THE INVENTION

The above stated problem of achieving easy access to a toilet roll continues to exist despite the crowded prior art. My toilet paper dispenser system employs novel features and structure to provide a solution to this longstanding problem. The result is a substantially improved toilet paper dispenser system which is not anticipated, rendered obvious, suggested, or implied by any prior art references, either alone or in any combination thereof. My system comprises an elongated support arm having a strategically situated flexible component, a mounting attachment, and a toilet roll holder that is functional in a wide variety of orientations.

It is one of the main objects of the present invention to provide a toilet paper dispenser system that facilitates easy access to a roll of toilet paper and can be used in a wide variety of bathroom situations by a wide variety of users.

It is still another object to provide a toilet paper dispenser system that requires minimal dexterity to adjust the position of the toilet roll holder, and is suitable for use by young children and people with injuries or illnesses such as arthritis.

It is still another object to provide a toilet paper dispenser system, employing a safe elongated arm, for which a collision between the arm and a person is unlikely to result in damage to the system or injury to the person.

It is still another object to provide a toilet paper dispenser system that will not interfere with normal bathroom operation, including cleaning.

It is still another object to provide a toilet paper dispenser system that allows the position of the toilet paper roll to be easily adjusted to a wide range of locations in three dimensions.

It is still another object to provide a toilet paper dispenser system that can support a toilet roll, and dispense toilet paper, in a wide variety of orientations without the roll falling off.

Other objects and advantages of the present invention will become apparent from a consideration of the detailed description of the invention as well as the drawings. It is intended that these objects and advantages are within the scope of the present invention.

BRIEF DESCRIPTION OF THE DRAWINGS

The following detailed description of my invention makes reference to the accompanying drawings wherein.

DETAILED DESCRIPTION OF THE PREFERRED EMBODIMENT

I now refer to the drawings to aid in providing a detailed description of the preferred embodiment of my toilet paper dispenser system.

Figure 1:
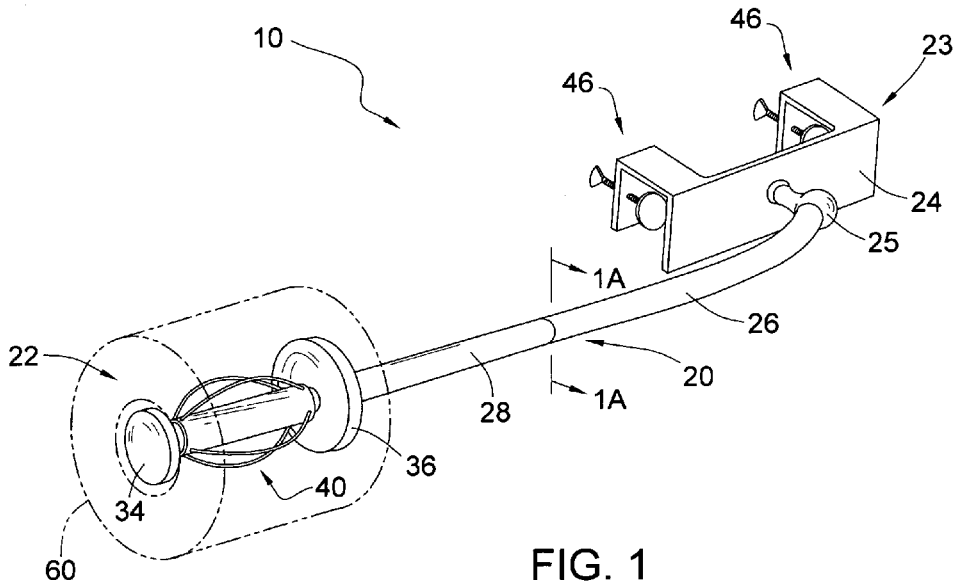
FIG. 1 is a perspective view of my preferred embodiment toilet paper dispenser system.
Figure 1A:
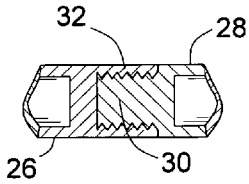
FIG. 1A is a cross sectional view taken along line 1A-1A of FIG. 1.

As seen in FIG. 1, my preferred embodiment toilet paper dispenser system 10 comprises a mounting attachment 23 which includes a metal plate base member 24 having adjustable C-clamps 46 at its ends. Base 24 is sufficiently flexible to be bent to conform to the shape of toilet tanks with curved surfaces. Attached to base 24 is an elongated support arm 20. Arm 20 has a joint member 25 which is attached to base 24 equidistantly from C-clamps 46. The length of arm 20 is about forty five centimeters, which is a convenient length representative of the distance between the toilet tank and the front of the toilet bowl. Arm 20 is comprised of an elongated flexible arm segment 26, in the form of a commercially available flexible metal gooseneck pipe, which terminates at one end in joint 25 and is attached at the other end to a rigid plastic tube extension member 28. The joint between segments 26 and 28 is shown in cross section in FIG. 1A. A male threaded member 30 is screwed into female threaded member 32. Extension member 28 terminates in a toilet roll holder 22 as shown in FIG. 1 and FIG. 1B.

Figure 1B:
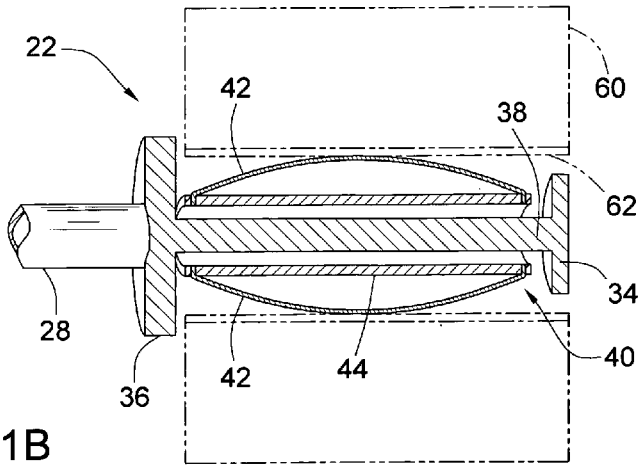
FIG. 1B is a partial sectional view drawing of the partial assembly of the preferred embodiment of my invention.

Referring to FIG. 1 and FIG. 1B, holder 22 is comprised of a three quarter centimeter diameter cylindrical plastic shaft 38, with front and rear plastic disk stopper members, 34 and 36 respectively, attached at its ends. Shaft 38 is about the same length as a toilet roll core; however a wide variety of lengths are possible. A toilet roll 60 with core 62, shown in phantom, is held on holder 22 by a rotatable frictional support member 40. Member 40 comprises a plastic tube segment 44 with interior diameter slightly larger than the diameter of shaft 38. Four metal wire segments, which are each about twelve centimeters in length, are attached to tube 44 to form evenly spaced spring arcs 42 that provide a radial spring force. Tube member 44 is supported coaxially on shaft 38, between front and rear stoppers 34 and 36, and can rotate thereon. Front stopper 34 is small enough to be passed through core 62. Rear stopper 36, which is attached to tube 28, is too large to pass through core 62.

Figure 2:
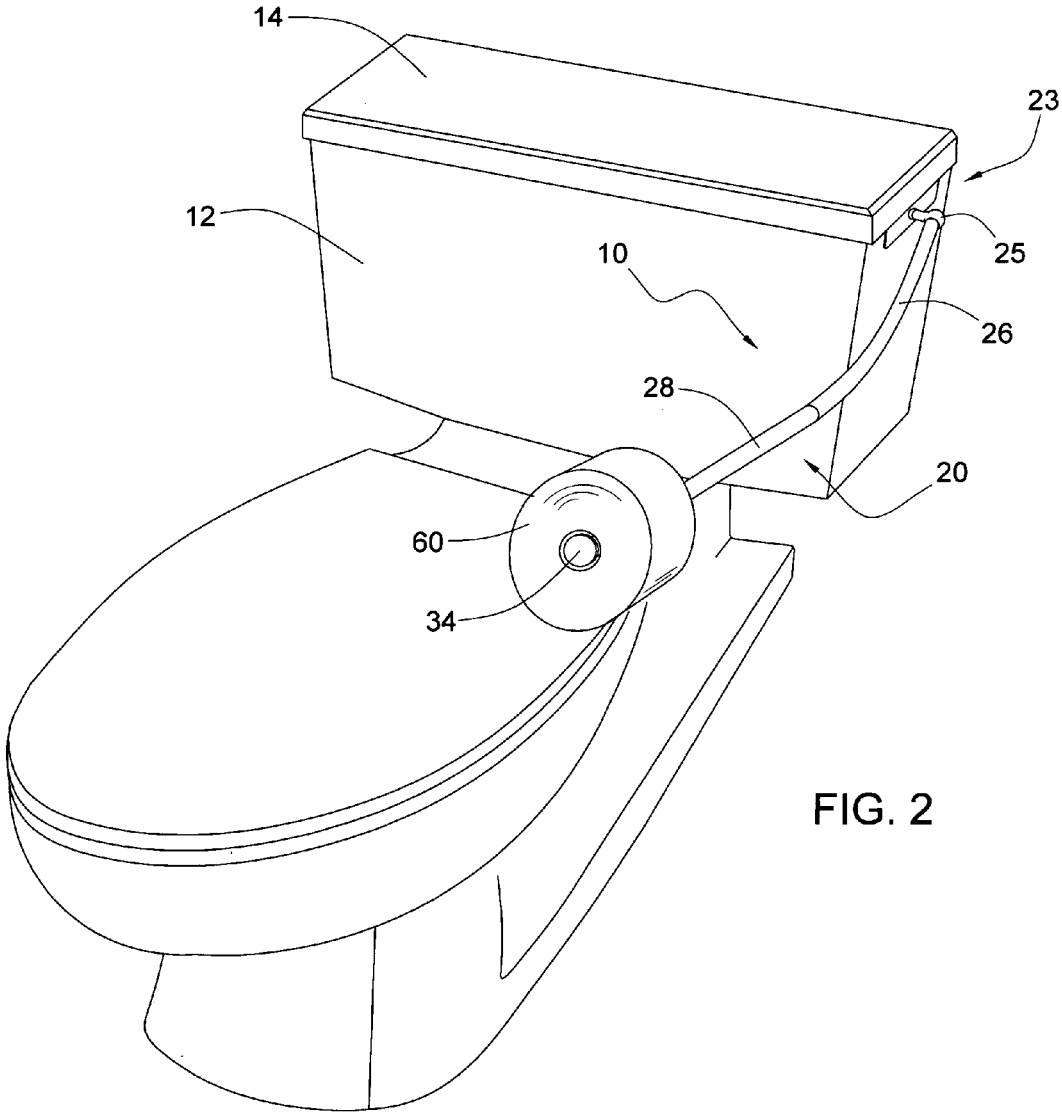
FIG. 2 is a perspective view of my preferred embodiment toilet paper dispenser system mounted to the tank of a toilet.
Figure 2A:
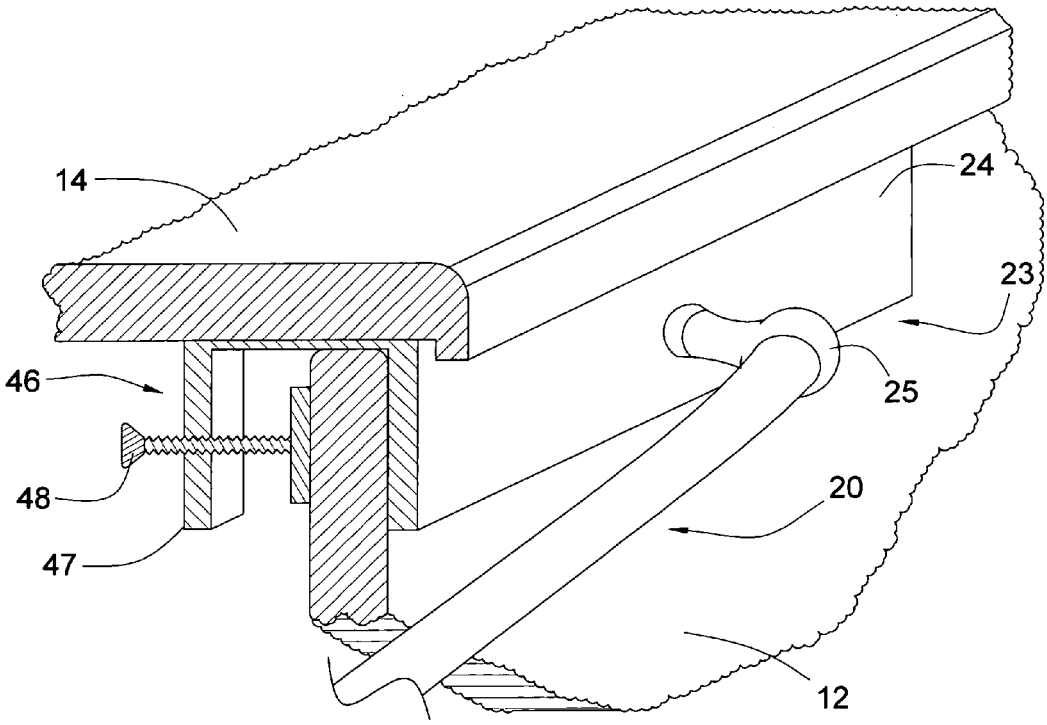
FIG. 2A is a perspective sectional view drawing of the partial assembly of the preferred embodiment of my invention attached to a toilet tank.

Shown in FIG. 2 and FIG. 2A is my preferred embodiment system 10 attached to a toilet tank 12. Referring to FIG. 2A, C-clamps 46 each have a bracket member 47 and a threaded member 48. Bracket members 47 are placed over the edge of the wall of tank 12 and threaded members 48 are tightened to provide a gripping force to fasten clamp 46 to tank 12. Lid 14 rests on top of tank 12 and the weight of lid 14 provides a pinning force on brackets 47 to aid in securing system 10 to tank 12.

Figure 3:
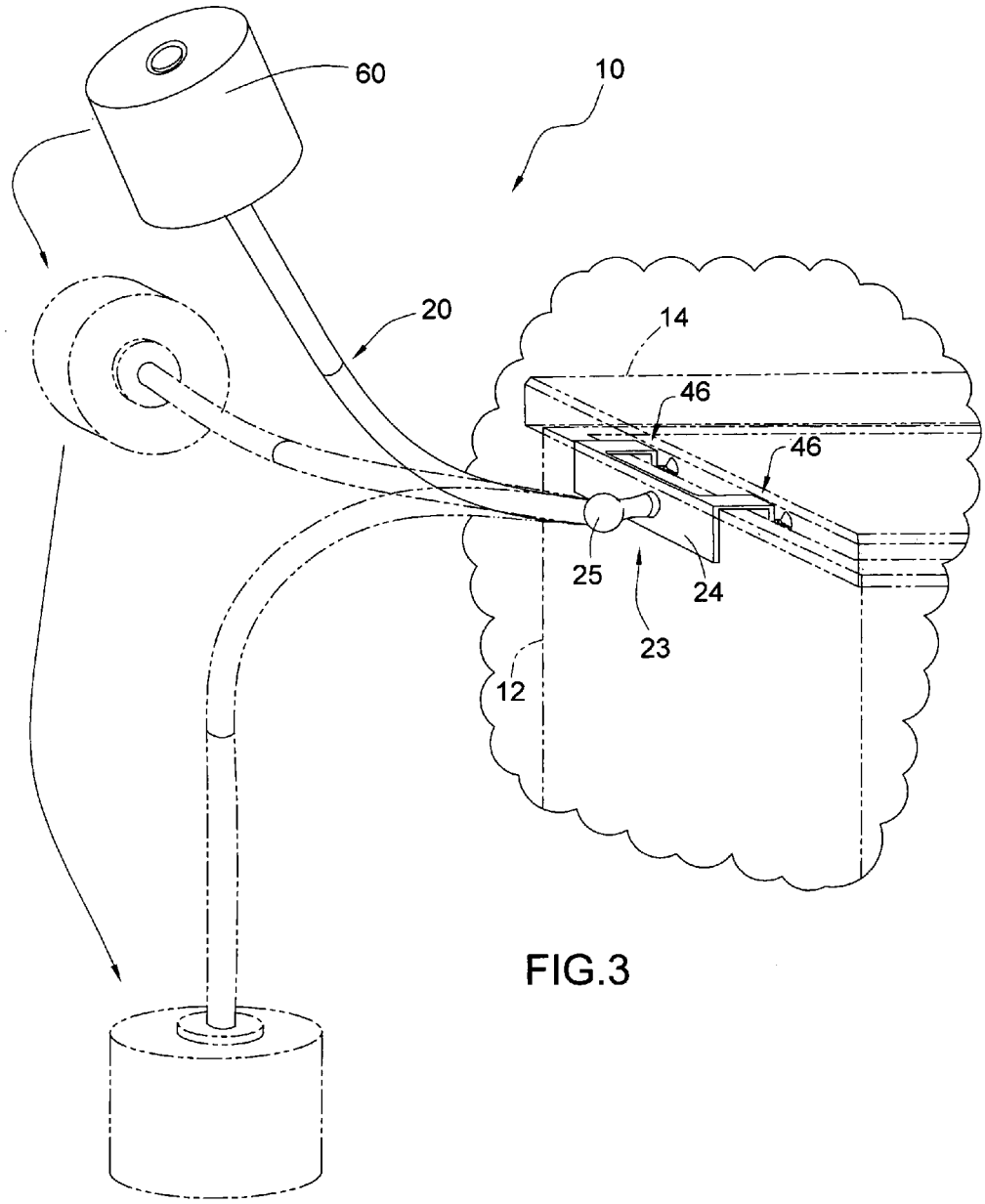
FIG. 3 is a perspective view depicting the adjustment of my preferred embodiment toilet paper dispenser system.

Referring to FIG. 1 and FIG. 3, clamps 46 are offset by about four centimeters from the location at which joint 25 joins base 24. Referring to FIG. 3, this adaptation prevents disturbance on lid 14 caused by the rotation of mount 23 about joint 25 when arm 20 is adjusted. By positioning clamps 46 at a sufficient distance from joint 25 the effectiveness of the pinning force of lid 14 on brackets 47 is accordingly increased thereby preventing disturbance of lid 14 for any normal adjustment of arm 20. This adaptation removes the need for excessive tightening of clamps 46, or the use of additional agents, such as adhesive, to secure system 10 to tank 12.

As seen in FIG. 1 and FIG. 2, the flexible segment 26 is positioned close to mounting attachment 23 on support arm 20 making the entire length of arm 20 movable in three dimensions. Arm 20 thus constructed, will not represent a rigid obstruction in any direction. This reduces the risk of damage to system 10 or injury to a person in the event of a collision between them. Furthermore, system 10 has universal adjustability in three dimensions and the position of roll 60 can be easily adjusted to accommodate people of all heights and sizes.

Referring to FIG. 1, system 10 can support the weight of roll 60 in any user chosen position. This is accomplished by employing suitably rigid flexible arm segment 26, and light-weight plastic extension member 28 and holder 22 to reduce the load on segment 26. The combined weight of member 28 and holder 22 is fifty grams. Referring to FIG. 1B, holder 22 is further adapted to be lightweight by having the diameters of shaft 38 and tube 44 relatively small compared to the diameter of core 62. Core 62, which has a typical four centimeter diameter, is passed over front stopper 34 onto frictional member 40. Light metal spring arcs 42 engage core 62 with sufficient force to frictionally hold roll 60 on holder 22 in any orientation, even during the dispensing of paper from roll 60. Rear stopper 36 obstructs roll 60 from passing onto arm 20 and therefore facilitates correct placement of roll 60 on holder 22. Holder 22 allows for low-contact replacement of roll 60. That is, a user can replace roll 60 without having to grasp or manipulate parts of holder 22. This avoids any significant disturbance to the positioning of holder 22 during the replacement of roll 60 and allows for convenient replacement of roll 60 in any orientation that it happens to be in.

DETAILED DESCRIPTION OF ALTERNATIVE EMBODIMENTS

Figure 4:
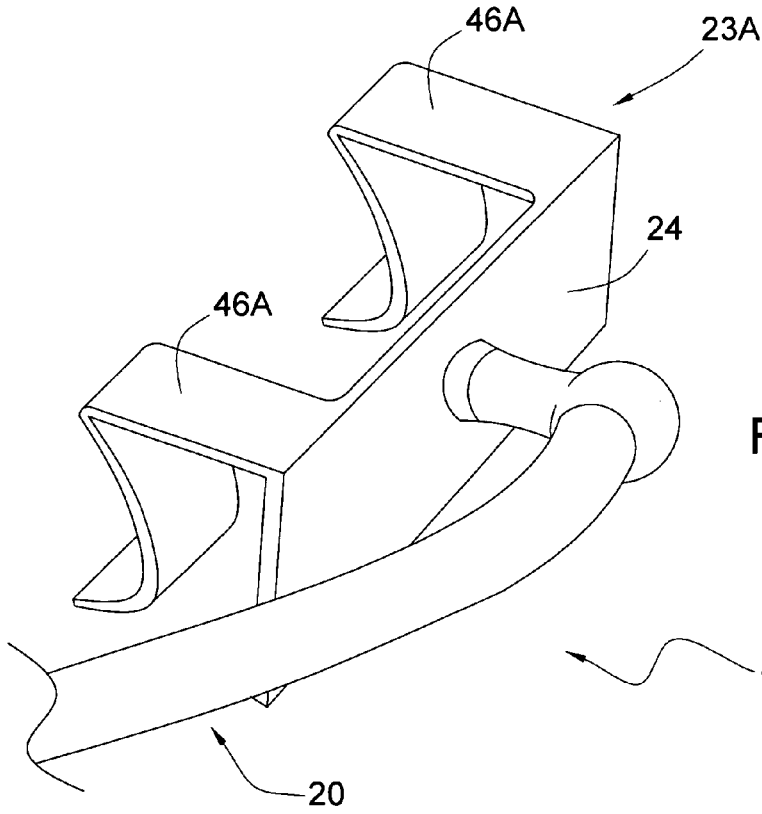
FIG. 4 is a perspective view drawing of the partial assembly of an alternative embodiment of my invention.
Figure 5:
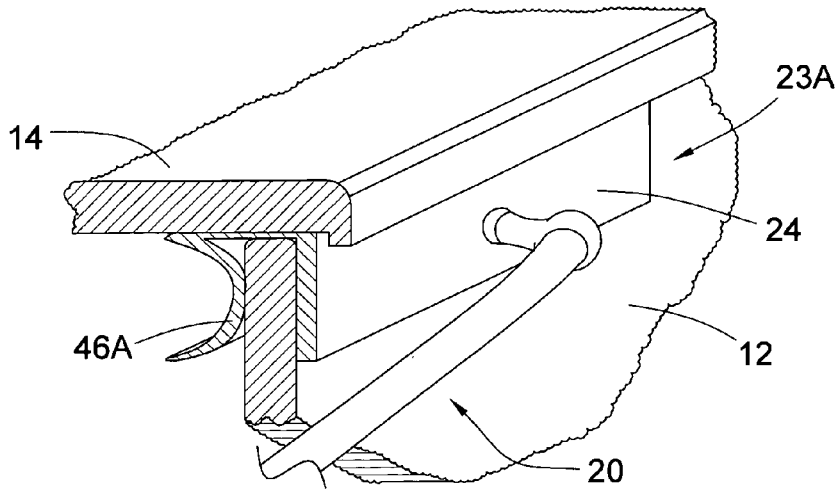
FIG. 5 is a perspective sectional view drawing of the partial assembly of the alternative embodiment of FIG. 4 mounted to the tank of a toilet.

An alternative embodiment 10A of my invention is shown in FIG. 4 and FIG. 5. It is identical to system 10 except that mount 23 is replaced with a mount 23A in which spring clips 46A are used in place of C-clamps 46. As seen in FIG. 4 and FIG. 5, clips 46A are of conventional construction having a U shaped bracket with one arm bent in order to apply a spring force to fasten mount 23A to the wall of tank 12.

Figure 6:
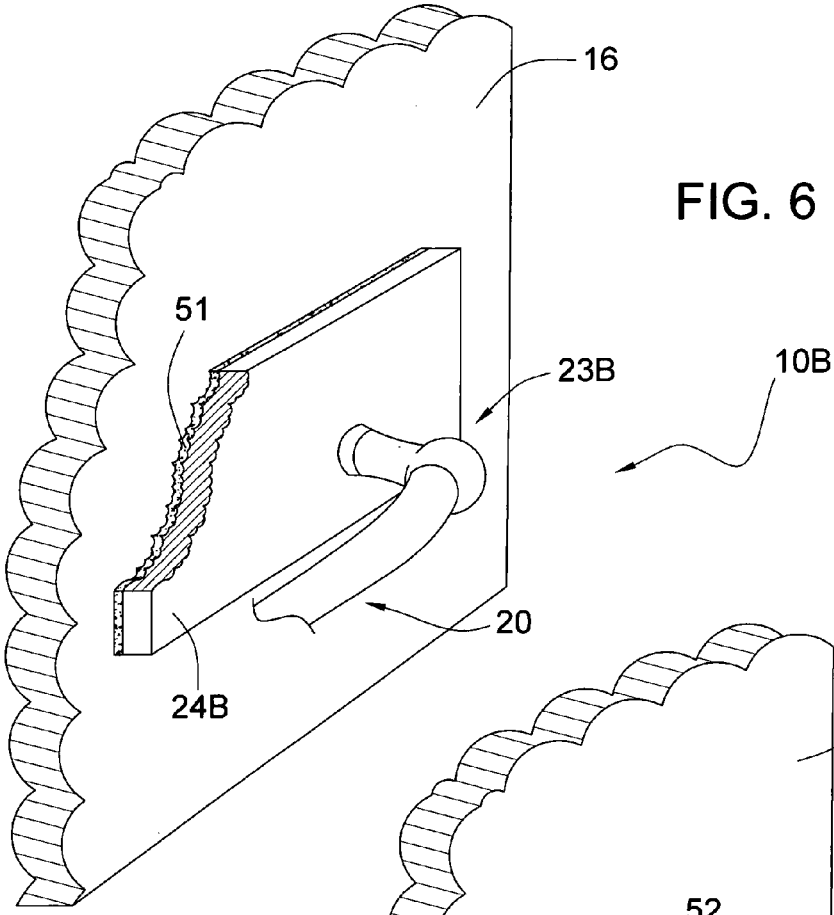
FIG. 6 is a partial perspective view drawing of the partial assembly of an alternative embodiment of my toilet paper dispenser system mounted to a surface using an adhesive.

My dispenser system can also be attached to the toilet tank, or a surface such as a wall or cabinet, using alternative methods. FIG. 6 shows an alternative embodiment 10B, which is identical to system 10 except that mount 23 is replaced with a mount 23B, which comprises a base member 24B that is secured to a surface using an adhesive 51.

Figure 7:
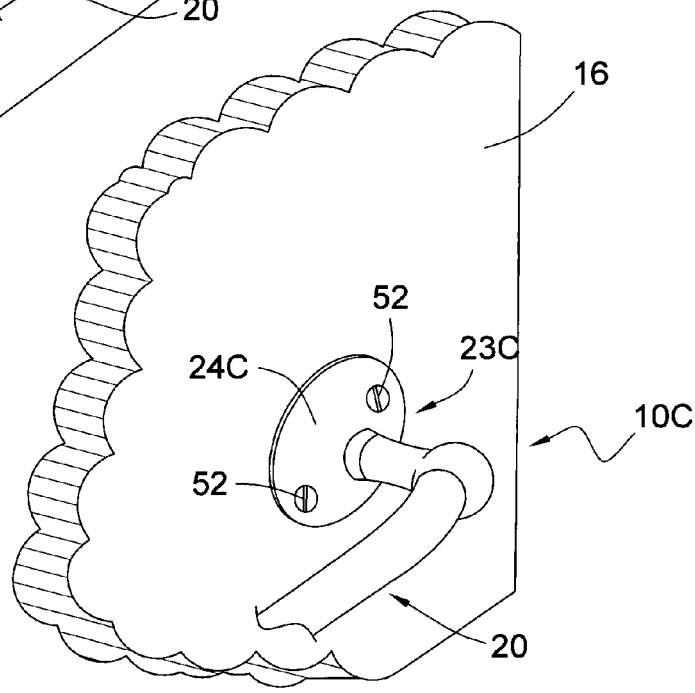
FIG. 7 is a perspective view drawing of the partial assembly of an alternative embodiment of my toilet paper dispenser system mounted to a surface using screws.

Another alternative embodiment 10C is shown in FIG. 7. It is identical to system 10 except that mounting attachment 23 is replaced with an attachment 23C. Attachment 23C comprises a metal base member 24C that is fastened to surface 16 using threaded members 52 in the form of metal screws. My preferred embodiment 10 has the advantage over embodiments 10B and 10C in that it can be mounted in a temporary and non-destructive manner to a rigid structure.

Figure 8:
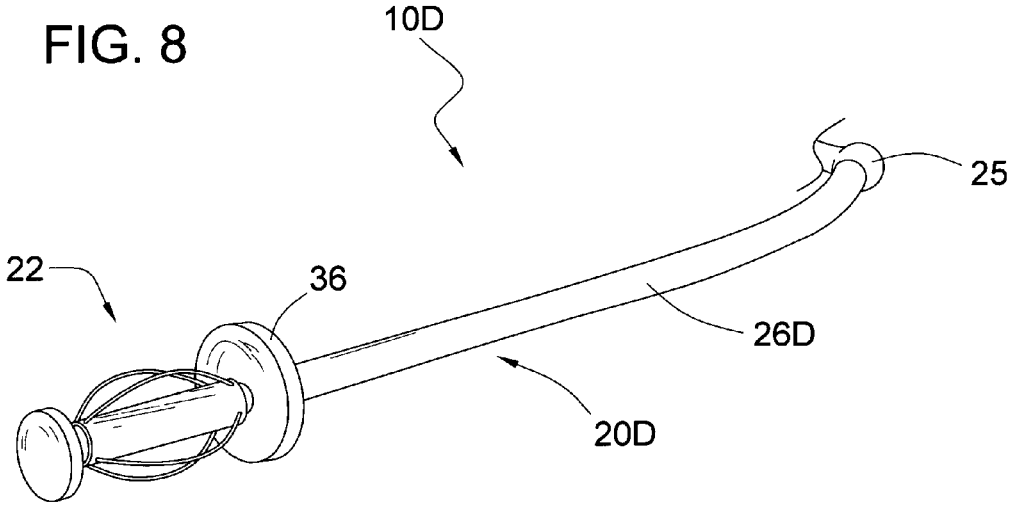
FIG. 8 is a perspective view drawing of the partial assembly of an alternative embodiment of my invention.

FIG. 8 shows an alternative embodiment 10D which is identical to system 10 except that support arm 20D consists of a flexible metal gooseneck pipe segment 26D that terminates in joint 25 at one end and is attached to holder 22 at the other end. Arm 20D is the same length as arm 20. Segment 26D is sufficiently rigid for system 10D to support the weight of roll 60 on holder 22 in any orientation. System 10D has the disadvantage when compared to arm 10 in that arm 20D is heavier than arm 20. Consequently, system 10D cannot support as much weight on holder 22 as can system 10 without arm 26D being more rigid than arm 26.

Figure 9:
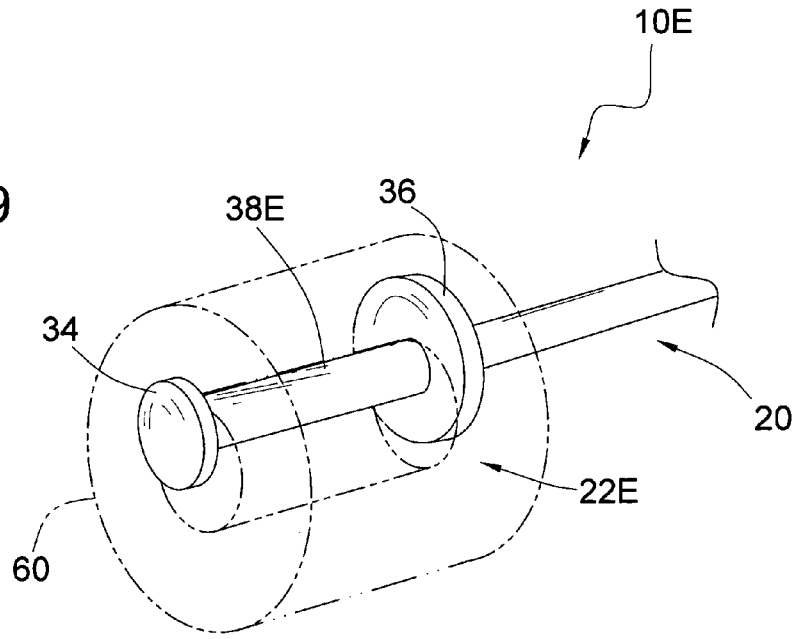
FIG. 9 is a perspective view drawing of the partial assembly of an alternative embodiment of my invention.

FIG. 9 shows an alternative embodiment 10E which is identical to system 10 except that holder 22 is replaced with a holder 22E. Holder 22E has a shaft 38E having front and rear stopper members 34 and 36 attached at its ends. Shaft 38E is sufficiently long for roll 60 to rest on it between stoppers 34 and 36. Stoppers 34 and 36 support roll 60 on holder 22E in a wide variety of orientations, though not vertically downwards, as seen in FIG. 3, which is possible for embodiments of my dispenser system that employ frictional member 40.

CONCLUSION, SCOPE AND RAMIFICATIONS

I have provided a full disclosure of the toilet paper dispenser system of my invention. The reader can see that my dispenser system offers significant advantages over prior art devices. My dispenser system employs novel features and structure making it highly suited for use when mounted to the tank of a toilet and it therefore can be used in a wide variety of bathroom situations. It is easily adjustable in three dimensions making it a more effective solution to the problem of easy access to the toilet paper roll than prior art devices, which are only adjustable in one or two dimensions. Furthermore, it requires minimal dexterity and no extraneous manipulation to adjust the position of the toilet roll holder so that people with mobility impairments or injuries can use it. My dispenser system takes advantage of an elongated support arm that is safe in the sense that a collision between a person and the support arm will result in the support arm giving way. This avoids damage to the dispenser system or injury to a person as would occur if the extended arm were rigid and therefore immovable in any direction.

The above description includes many specific details of my invention. These are meant purely as non-limiting illustrations of some of the preferred embodiments of my toilet paper dispenser system and should not be construed as limiting its scope. My dispenser system can be attached to a toilet tank or a rigid structure using clamps, clips, adhesive, screws, or any combination of these. Additionally, the mounting attachment may be a pipe clamp for securing my dispenser system to a pipe.

The mounting attachment may be attached to the support arm in any manner and at any angle, and use any joint type including a ball or pivot joint. The support arm may be of any elongated form that does not constitute a rigid obstruction in the bathroom. The flexible arm segment may be a metal gooseneck arm or a flexible sectioned plastic arm comprised of ball joints. It may also be a series of pivot joints constructed so as to be bendable in three dimensions. In general, any type of flexible arm can be used. The toilet roll holder may be of any type that is functional in a wide variety of orientations, including a U-shaped holder with a removable shaft, or spindle, for supporting a toilet roll; or a holder for which the toilet roll is held on a shaft using a spring activated stopper which must be manipulated in order to remove the roll from the holder. The holder can be attached to the support arm in any manner and at any angle, and can use any joint type including a ball or pivot joint.

Included in the scope of my invention are variations made to its parts in size, materials, shape, form, exact construction, function and manner of operation, and elimination or duplication of parts. The scope of my invention covers the cases where parts are connected or associated with adjacent elements in a different manner and are made integrally or separately. Accordingly, the scope of my invention should be determined not by the embodiments illustrated, but by the appended claims and their legal equivalents.

I claim:

1. A universal toilet paper dispenser system, which accommodates a wide variety of bathroom situations and users, comprising in combination:

a toilet roll holder having a means for supporting and dispensing toilet paper from a toilet paper roll in a multitude of orientations; and an elongated support arm, having first and second ends, attached to said holder at said first end, said arm comprising a flexible arm segment that is bendable in three dimensions and sufficiently rigid for said system to support the weight of said roll in a multitude of user chosen positions; and a mounting attachment, for fastening said system to a toilet tank, comprising a base member and two fastening members for gripping the wall of said toilet tank, said fastening members being attached to said base substantially separated from each other, and wherein said support arm is attached, at said second end, to said base in between and at a predetermined distance from both said fastening members, wherein said support arm further includes an elongated extension member, wherein said flexible segment is attached at one of its ends to said mounting attachment and at its other end to said extension member, whereby said support arm will not constitute an elongated rigid obstruction in a bathroom.

2. The toilet paper holder system of claim 1, wherein said holder comprises a shaft, and front and rear stopper members attached one to either end of said shaft, said rear stopper is attached to said support arm and said roll can be passed over said front stopper and is obstructed from further passage by said rear stopper, wherein said shaft is sufficiently long for said roll to rest on it between said front and rear stoppers.

3. The toilet paper dispenser system of claim 1, wherein said fastening members are adjustable C-clamps having threaded members that can be tightened to grip the wall of said toilet tank.

4. The toilet paper dispenser system of claim 1, wherein said fastening members are spring clips employing a spring force to grip the wall of said toilet tank.

5. The toilet paper dispenser system of claim 1, wherein said base member is flexible for the purpose of mounting said system to toilet tanks with varying wall surface curvature.

6. The toilet paper dispenser system of claim 1, wherein said toilet roll holder comprises:

a shaft, of predetermined dimensions, and front and rear stopper members attached one to either end of said shaft; and a frictional support member, of predetermined dimensions, mounted rotatably on said shaft between said front and rear stopper members, said frictional member having a spring means for providing sufficient force on the core of said roll to hold said roll onto said holder, and allow dispensing of said toilet paper, in any orientation, wherein said rear stopper is attached to said support arm and said roll can be passed over said front stopper and is obstructed from further passage by said rear stopper.

7. The toilet paper dispenser system of claim 6, wherein said flexible segment is comprised of a flexible metal gooseneck pipe.

8. A universal toilet paper dispenser system comprising in combination:

a mounting means, for fastening said system to a toilet tank, comprising at least one fastening means having a bracket member for placing over the edge of a toilet tank wall under the toilet tank lid, and a gripping means to tighten said mounting means to said wall; and a means for dispensing toilet paper that includes a means for low contact replacement of a toilet paper roll, wherein said dispensing means includes a frictional means that can rotate for the purpose of dispensing toilet paper, said frictional means providing sufficient force on the core of said toilet roll to hold said roll on said dispensing means, and allow dispensing of said toilet paper, in any orientation; and an elongated support arm, having first and second ends, attached to said dispensing means at said first end and attached to said mounting means at said second end, said support arm having a flexible means that is bendable in three dimensions and sufficiently rigid for said system to support the weight of said roll in a multitude of user chosen positions, wherein said flexible means is situated sufficiently close to said second end on said support arm, so that said support arm will not constitute an elongated rigid obstruction in a bathroom.

9. The toilet paper dispenser system of claim 8, wherein said mounting means further includes a means to prevent significant disturbance to said lid caused by any normal adjustment of said support arm.

10. A universal toilet paper dispenser system, which accommodates a wide variety of bathroom situations and users, comprising in combination:

a toilet roll holder having a means for supporting and dispensing toilet paper from a toilet paper roll in a multitude of orientations; and a mounting attachment, for fastening said system to a toilet tank, comprising at least one fastening member having a bracket member for placing over the edge of a toilet tank wall under the toilet tank lid, and a gripping means to secure said attachment to said wall; and an elongated support arm, having first and second ends, attached to said holder at said first end and attached to said mounting attachment at said second end, said support arm having a flexible arm segment that is bendable in three dimensions and sufficiently rigid for said system to support the weight of a toilet roll, on said holder, positioned to be conveniently accessed by a user seated on said toilet, wherein said flexible segment is situated sufficiently close to said second end on said support arm, so that said support arm will not constitute an elongated rigid obstruction in a bathroom.

11. The toilet paper dispenser system of claim 10, wherein said support arm further includes an elongated extension member, said extension member is attached at one of its ends to said toilet roll holder and at its other end to said flexible arm segment.

12. The toilet paper dispenser system of claim 11, wherein said toilet roll holder further includes a means for low contact removal of a roll of toilet paper.

13. The toilet paper dispenser system of claim 10, wherein said toilet roll holder further includes a means for low contact removal of a roll of toilet paper.

14. The toilet paper dispenser system of claim 10, wherein said mounting attachment includes a base member and at least two bracket members for placing over the edge of a toilet tank wall under the toilet tank lid, said brackets being attached to said base substantially separated from each other, and wherein said support arm is attached to said base in between and at a predetermined distance from both said bracket members.

15. The toilet paper dispenser system of claim 14, wherein said toilet roll holder further includes a means for low contact removal of a roll of toilet paper.

16. The toilet paper dispenser system of claim 14, wherein said support arm further includes an elongated extension member, said extension member is attached at one of its ends to said toilet roll holder and at its other end to said flexible arm segment.

17. The toilet paper dispenser system of claim 16, wherein said flexible segment is comprised of a flexible metal gooseneck pipe.

18. The toilet paper dispenser system of claim 14, wherein said toilet roll holder further includes a means for low contact removal of a roll of toilet paper, and wherein said support arm further includes an elongated extension member, said extension member is attached at one of its ends to said toilet roll holder and at its other end to said flexible arm segment.

19. The toilet paper disperser system of claim 18, wherein said flexible segment is comprised of a flexible metal gooseneck pipe.

20. The toilet paper dispenser system of claim 10, wherein said flexible segment is comprised of a flexible metal gooseneck pipe.

* * * * *